US006797230B1

(12) United States Patent
Kuhlmann et al.

(10) Patent No.: US 6,797,230 B1
(45) Date of Patent: Sep. 28, 2004

(54) GAS STOPPER BRICK FOR METALLURGICAL VESSELS WITH A SEALING BODY THAT IS SUBJECT TO SCREW PRESSURE SPRINGS

(76) Inventors: Juergen Kuhlmann, Bebelstrasse 77, D-46049 Oberhausen (DE); Eberhard Heimann, Am kleinen Baeumchen 8, D-53557 Bad Hoenningen (DE); Klaus Ruwier, Am schwarzen Kreuz 1a, D-53557 Bad Hoenningen (DE); Rainer Patron, Quellenstrasse 38, D-56656 Brohl-Luetzingen (DE)

( * ) Notice: Subject to any disclaimer, the term of this patent is extended or adjusted under 35 U.S.C. 154(b) by 33 days.

(21) Appl. No.: 10/110,104

(22) PCT Filed: Oct. 9, 2000

(86) PCT No.: PCT/EP00/09875

§ 371 (c)(1),
(2), (4) Date: Jul. 11, 2002

(87) PCT Pub. No.: WO01/27337

PCT Pub. Date: Apr. 19, 2001

(30) Foreign Application Priority Data

Oct. 8, 1999 (DE) ..... 199 48 848

(51) Int. Cl.[7] ..... C21C 5/48
(52) U.S. Cl. ..... 266/220; 222/603
(58) Field of Search ..... 222/603; 266/217, 266/220

(56) References Cited

U.S. PATENT DOCUMENTS 4,616,809 A * 10/1986 Hoffgen ..... 266/220

FOREIGN PATENT DOCUMENTS

DE 3341446 C1 7/1985
DE 0 679 723 A1 11/1995

* cited by examiner

*Primary Examiner*—Scott Kastler
(74) *Attorney, Agent, or Firm*—Crowell & Moring LLP

(57) ABSTRACT

This invention relates to a gas bubbler stone for metallurgical vessels having a porous, gas-permeable molded stone (1) made of a refractory material, a partial sheathing enclosing it in a gastight manner, the sheathing being made of a metal casing (2), which extends around the lateral peripheral surface of the molded stone, and a sheet metal cover (3) which covers the outer end face of the molded stone, and a gas delivery pipe (6) which extends from the under side of the sheet metal cover and is joined to the sheet metal cover in the area of a gas inlet opening (7) formed in the sheet metal cover, and which has a narrowed cross section (9) at a distance from the gas inlet opening of the sheet metal cover, and a closing body (10), which is movable at least in the axial direction of the gas delivery pipe, is situated in the pipe section between the sheet metal cover (3) and the narrowed cross section (9), its cross section being smaller than the inside diameter of the gas delivery pipe (6) and greater than the narrowed cross section, and which, like a non-return valve, is loaded in the direction of the narrowed cross section which defines a valve seat (11) by a helical compression spring (12) which is supported on the sheet metal cover. To guarantee a reliable gas supply even at a high gas pressure, the gas inlet opening (7) is situated at least partially outside the partial circle of the helical compression spring (12).

38 Claims, 1 Drawing Sheet

Figure 1:
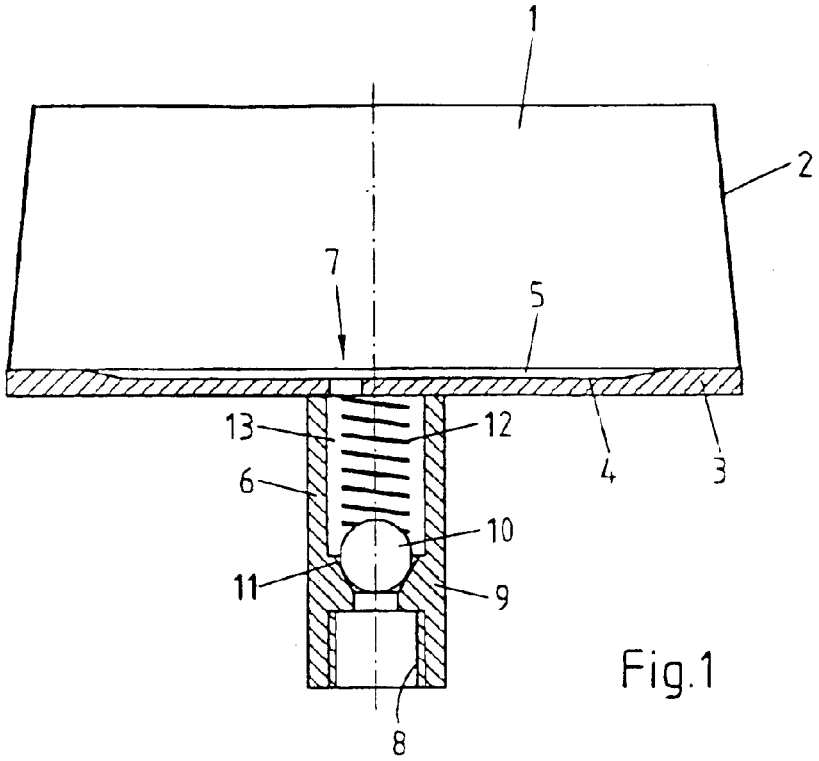

GAS STOPPER BRICK FOR METALLURGICAL VESSELS WITH A SEALING BODY THAT IS SUBJECT TO SCREW PRESSURE SPRINGS

This invention relates to a gas bubbler stone for metallurgical vessels having a porous, gas-permeable molded stone of a refractory material, a gastight partial sheathing surrounding it, made of a metal casing extending around the lateral peripheral surface of the molded stone and a sheet metal cover which covers the outer end face of the molded stone, and a gas delivery pipe which extends from the lower side of the sheet metal cover and is connected to the sheet metal cover in the area of a gas inlet opening formed in the area of a sheet metal cover and has a narrowed cross section at a distance from the gas inlet opening of the sheet metal cover, and a closing body which is movable at least in the axial direction of the gas delivery pipe is arranged in the pipe section between the sheet metal cover and the narrowed cross section, the cross section of this closing body being smaller than the inside diameter of the gas delivery pipe and larger than the narrowed cross section, and like a non-return valve, this closing body is loaded in the direction of the narrowed cross section which defines a valve seat by a helical compression spring that is supported on the sheet metal cover.

Such a gas bubbler stone is know from German Patent 33 41 446 C1. With this gas bubbler stone, breakthroughs of melt into the connected gas feed line can be largely prevented or their effects can be minimized. However, there is the problem with the known gas bubbler stone that the gas inlet opening becomes sealed by the helical compression spring at high gas pressures, which lead to complete compression of the helical compression spring.

Thus, there is the risk of the gas supply being interrupted precisely when a relatively high gas volume flow is needed.

The object of the present invention is to create a gas bubbler stone of the type defined in the preamble, which will minimize the risk of melt breakthroughs on the one hand while also on the other hand guaranteeing a reliable gas supply even at a high gas volume flow at a high gas pressure accordingly.

This object is achieved according to the present invention by the fact that the gas inlet opening is situated at least partially outside the partial circle of the compression spring.

The solution according to the present invention yields a bubbler stone, which minimizes the risk of melt breakthroughs as well as ensuring a supply of gas from the gas delivery pipe into the gas bubbler stone in the event that the helical compression spring is completely compressed because of a high gas pressure.

An advantageous embodiment of the gas bubbler stone according to this invention is characterized in that the gas inlet opening consists of three boreholes, whose center axes are each situated eccentrically with respect to the center axis of the gas delivery pipe. The center axes of the boreholes are preferably situated on a common circle and are spaced uniformly apart. In this way, a relatively large total orifice cross section and a stable abutment for the helical compression spring are achieved in the area of the gag inlet opening formed by the boreholes on the sheet metal cover.

Another advantageous embodiment of the gas bubbler stone according to this invention consists of the valve seat being designed in one piece with the gas delivery pipe. This reduces the number of individual parts to be joined, which reduces the manufacturing and storage costs for the gas bubbler stone.

According to another preferred embodiment, the sheet metal cover is designed like a plate and has a recess, which together with the bottom side of the molded stone defines a hollow space. The recess may preferably be produced with a suitable press. Again, this makes it possible to reduce the number of individual parts to be joined together.

Other preferred and advantageous embodiments of this invention are characterized in the subclaims.

Figure 2:
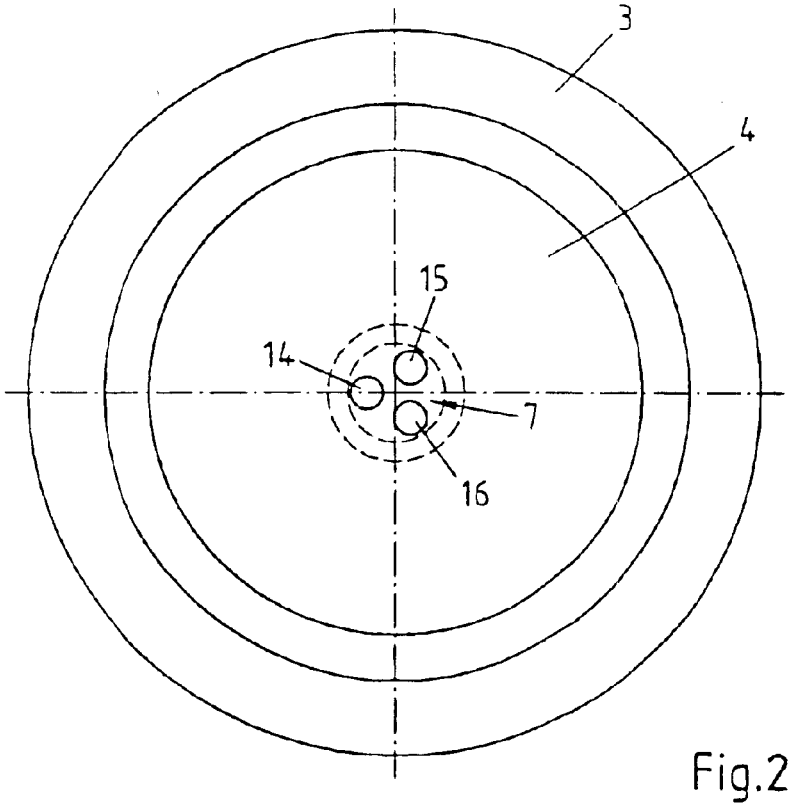

This invention is explained in greater detail below on the basis of a drawing illustrating one embodiment. Specifically, they show:

FIG. 1 a cross-sectional view of a gas bubbler stone according to the present invention having a molded stone made of a refractory material, and FIG. 2 a top view of the gas bubbler stone according to FIG. 1, where the molded stone has been omitted for the sake of simplicity.

The gas bubbler stone illustrated in the drawing consists of a gas-permeable molded stone 1 in the form of a truncated cone. The gas bubbler stone is used to introduce a scavenging gas such as argon into a metal. melt in a metallurgical vessel (not shown). To do so, the gas bubbler stone is built into the bottom or the wall of the metallurgical vessel.

The molded stone 1 in the form of a truncated cone is set in a gastight partial sheathing which is welded together from a metal casing 2 which extends around the lateral peripheral surface of the molded stone 1 and a sheet metal cover 3 which covers the outer end face of the molded stone 1. It can be seen that the sheet metal cover 3 is designed in the form of a plate and has a recess 4 which together with the lower side of the molded stone 1 defines a hollow space 5.

A gas delivery pipe 6 is provided on the under side of the sheet metal cover 3 and is welded to the sheet metal cover 3 in the area of a gas inlet opening 7 provided in the sheet metal cover 3. On its end facing away from the sheet metal cover 3, the gas delivery pipe 6 is provided with an inside thread 8 for connecting a gas line (not shown). As an alternative or in addition, an outside thread may also be provided on the gas delivery pipe 6. At a distance from the gas inlet opening 7, the gas delivery pipe 6 has a narrowed cross section 9, and a closing body in the form of a ball 10, which is movable in the axial direction of the gas delivery pipe 6, is arranged in the pipe section between the sheet metal cover 3 and the narrowed cross section 9. The narrowed cross section 9 of the gas delivery pipe 6 defines a conical valve seat 11, which is designed in one piece with the gas delivery pipe 6.

In the manner of a non-return valve, the ball 10 is loaded in the direction of the valve seat 11 by a helical compression spring 12, which is supported on the sheet metal cover 3. The helical compression spring 12 is dimensioned so that a free annular clearance 13 is provided between the inside wall of the gas delivery pipe 6 and the spring 12.

The gas inlet opening 7 is arranged with respect to the gas delivery pipe 6 and the helical compression spring 12 so that it is situated partially outside the partial circle of the helical compression spring 12. In the embodiment illustrated here, the gas inlet opening 7 consists of three boreholes 14, 15, 16, whose center axes are arranged eccentrically relative to the center axis of the gas delivery pipe 6. The center axes of the boreholes 14, 15, 16 lie on a common circle and are spaced with a uniform distance apart (see FIG. 2).

The gas bubbler stone is preferably produced by first shrinking the molded stone 1 in the form of a truncated cone in the conical metal casing 2. Then the plate-shaped sheet metal cover 3 is welded to the metal casing 2. The gas delivery pipe 6 may already be welded to the sheet metal cover 3 with the helical compression spring 12 and the closing ball 10.

List of Reference Notation

1 molded stone
2 sheet metal jacket
3 sheet metal cover
4 recess
5 hollow space
6 gas delivery pipe
7 gas inlet opening
8 inside thread
9 narrowed cross section
10 ball (closing body)
11 conical valve seat
12 helical compression spring
13 annular space
14 borehole
15 borehole
16 borehole

What is claimed is:

1. A gas bubbler stone for metallurgical vessels comprising:

a porous, gas-permeable molded stone made of a refractory material, a gastight partial sheathing enclosing it, made of a metal casing which extends around the lateral peripheral surface of the molded stone and a sheet metal cover which covers the outer end face of the-molded stone, and a gas delivery pipe which extends from the under side of the sheet metal cover and is joined to the sheet metal cover in the area of a gas inlet opening formed in the sheet metal cover and which has a narrowed cross section at a distance from the gas inlet opening of the sheet metal cover and a closing body which is movable at least in the axial direction of the gas delivery pipe and is situated in the pipe section between the sheet metal cover and the narrowed cross section, its cross section being smaller than the inside diameter of the gas delivery pipe and greater than the narrowed cross section, said closing body, like a non-return valve, being loaded in the direction of the narrowed cross section which defines a valve seat by a helical compression spring which is supported on the sheet metal cover, wherein a free annular clearance is provided between the inside wall of the gas delivery pipe and the helical compression spring and the cross section of the gas inlet opening at least partially overlaps the cross section of the free annular clearance.

2. The gas bubbler stone according to claim 1, wherein the gas inlet opening consists of several boreholes with center axes which are each arranged eccentrically with respect to the center axis of the gas delivery pipe.

3. The gas bubbler stone according to claim 1, wherein the gas inlet opening consists of three boreholes with center axes which are each arranged eccentrically with respect to the center axis of the gas delivery pipe.

4. The gas bubbler stone according to claim 2, wherein the center axes of the boreholes are situated on a common circle and are spaced with an equal distance apart.

5. The gas bubbler stone according to claim 1, wherein the closing body is a ball.

6. The gas bubbler stone according to claim 1, wherein the valve seat is designed in one piece with the gas delivery pipe.

7. The gas bubbler stone according to claim 1, wherein the valve seat is conical in design.

8. The gas bubbler stone according to claim 1, wherein the molded stone is designed in the form of a truncated one and is shrunk into the metal casing which is designed with a conical shape accordingly.

9. The gas bubbler stone according to claim 1, wherein the sheet metal cover is designed in the shape of a plate and has a recess which together with the lower side of the molded stone defines a hollow space.

10. The gas bubbler stone according to claim 1, wherein, on its end facing away from the sheet metal cover, the gas delivery pipe is provided with an inside thread and/or an outside thread for connecting a gas line.

11. The gas bubbler stone according to claim 2, wherein the gas inlet opening consists of three boreholes.

12. The gas bubbler stone according to claim 1, wherein the center axes of the boreholes are situated on a common circle and are spaced with an equal distance apart.

13. The gas bubbler stone according to claim 3, wherein the center axes of the boreholes are situated on a common circle and are spaced with an equal distance apart.

14. The gas bubbler stone according to claim 2, wherein the closing body is a ball.

15. The gas bubbler stone according to claim 3, wherein the closing body is a ball.

16. The gas bubbler stone according to claim 4, wherein the closing body is a ball.

17. The gas bubbler stone according to claim 2, wherein the valve seat is designed in one piece with the gas delivery pipe.

18. The gas bubbler stone according to claim 3, wherein the valve seat is designed in one piece with the gas delivery pipe.

19. The gas bubbler stone according to claim 4, wherein the valve seat is designed in one piece with the gas delivery pipe.

20. The gas bubbler stone according to claim 5, wherein the valve seat is designed in one piece with the gas delivery pipe.

21. The gas bubbler stone according to claim 2, wherein the valve seat is conical in design.

22. The gas bubbler stone according to claim 3, wherein the valve seat is conical in design.

23. The gas bubbler stone according to claim 4, wherein the valve seat is conical in design.

24. The gas bubbler stone according to claim 5, wherein the valve seat is conical in design.

25. The gas bubbler stone according to claim 6, wherein the valve seat is conical in design.

26. The gas bubbler stone according to claim 2, wherein the molded stone is designed in the form of a truncated one and is shrunk into the metal casing which is designed with a conical shape accordingly.

27. The gas bubbler stone according to claim 3, wherein the molded stone is designed in the form of a truncated one and is shrunk into the metal casing which is designed with a conical shape accordingly.

28. The gas bubbler stone according to claim 4, wherein the molded stone is designed in the form of a truncated one and is shrunk into the metal casing which is designed with a conical shape accordingly.

29. The gas bubbler stone according to claim 5, wherein the molded stone is designed in the form of a truncated one and is shrunk into the metal casing which is designed with a conical shape accordingly.

30. The gas bubbler stone according to claim 6, wherein the molded stone is designed in the form of a truncated one and is shrunk into the metal casing which is designed with a conical shape accordingly.

31. The gas bubbler stone according to claim 7, wherein the molded stone is designed in the form of a truncated one and is shrunk into the metal casing which is designed with a conical shape accordingly.

32. The gas bubbler stone according to claim 2, wherein the sheet metal cover is designed in the shape of a plate and has a recess which together with the lower side of the molded stone defines a hollow space.

33. The gas bubbler stone according to claim 3, wherein the sheet metal cover is designed in the shape of a plate and has a recess which together with the lower side of the molded stone defines a hollow space.

34. The gas bubbler stone according to claim 4, wherein the sheet metal cover is designed in the shape of a plate and has a recess which together with the lower side of the molded stone defines a hollow space.

35. The gas bubbler stone according to claim 5, wherein the sheet metal cover is designed in the shape of a plate and has a recess which together with the lower side of the molded stone defines a hollow space.

36. The gas bubbler stone according to claim 6, wherein the sheet metal cover is designed in the shape of a plate and has a recess which together with the lower side of the molded stone defines a hollow space.

37. The gas bubbler stone according to claim 7, wherein the sheet metal cover is designed in the shape of a plate and has a recess which together with the lower side of the molded stone defines a hollow space.

38. The gas bubbler stone according to claim 8, wherein the sheet metal cover is designed in the shape of a plate and has a recess which together with the lower side of the molded stone defines a hollow space.

* * * * *